US006035566A

United States Patent [19]

Fisher

[11] Patent Number: 6,035,566

[45] Date of Patent: Mar. 14, 2000

[54] PROFESSIONAL DESK TROPHY

[76] Inventor: Robert C. Fisher, 42 A Great Ring Rd., Sandy Hook, Conn. 06482

[21] Appl. No.: 09/211,667

[22] Filed: Dec. 14, 1998

[51] Int. Cl.[7] ..... B43M 3/00

[52] U.S. Cl. ..... 40/358; 428/13; 428/913.3

[58] Field of Search ..... 273/429, 459, 273/138.1; 428/13, 913.3; 206/315.9, 428

[56] References Cited

U.S. PATENT DOCUMENTS

| | | | |
|---|---|---|---|
| 5,551,832 | 9/1996 | Kelly | 206/315.9 |
| 5,715,947 | 2/1998 | Gonzales | 206/315.9 |

*Primary Examiner*—Cassandra H. Davis

[57] ABSTRACT

A desk trophy and decorative paperweight display constructed of a clear plastic parabolic dome(10), whose outer edge ends in a cylindrical shape, which is affixed to a clear plastic three-dimensional trapezoidal shaped base piece(11) via a square bottomed circular groove machined into the smaller horizontal surface in a diameter identical to that of the end diameter of the dome The dome is filled with an allotment of silver colored metal balls(14). A single gold colored metal ball(12)that is larger than the silver metal balls is supported within the most superior portion of the dome by the presence of the silver balls. Two inscribed plaques, one silver colored, one gold colored, are affixed to opposite vertical sides of the trapezoidal base. The number of silver metal balls relates to the number inscribed on the silver plaque with the wording: "Remember . . . Only One Person in ___#_____ Knows What You Know" The number and size of silver metal balls will vary with the intended use of the trophy. The gold colored plaque is inscribed with the recipient's name professional degree initials, school of graduation, and year of graduation. To construct the trophy, the dome is filled first with the gold colored metal ball, then with the silver metal balls, and is affixed to an inverted base with adhesive; the plaques are affixed to the base sides. The trophy recipients are mainly intended to be graduates of professional schools or programs with the number of silver balls and single gold ball in the dome representing the uniqueness of the graduate compared with the general population at large. Other applications are possible.

1 Claim, 3 Drawing Sheets

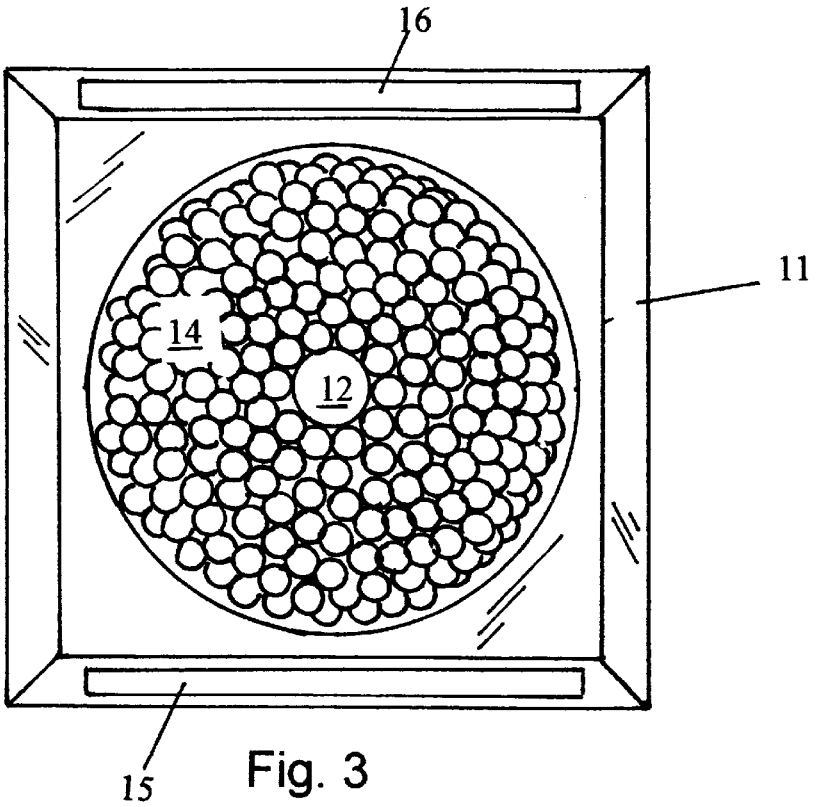
Fig. 3
Fig. 4
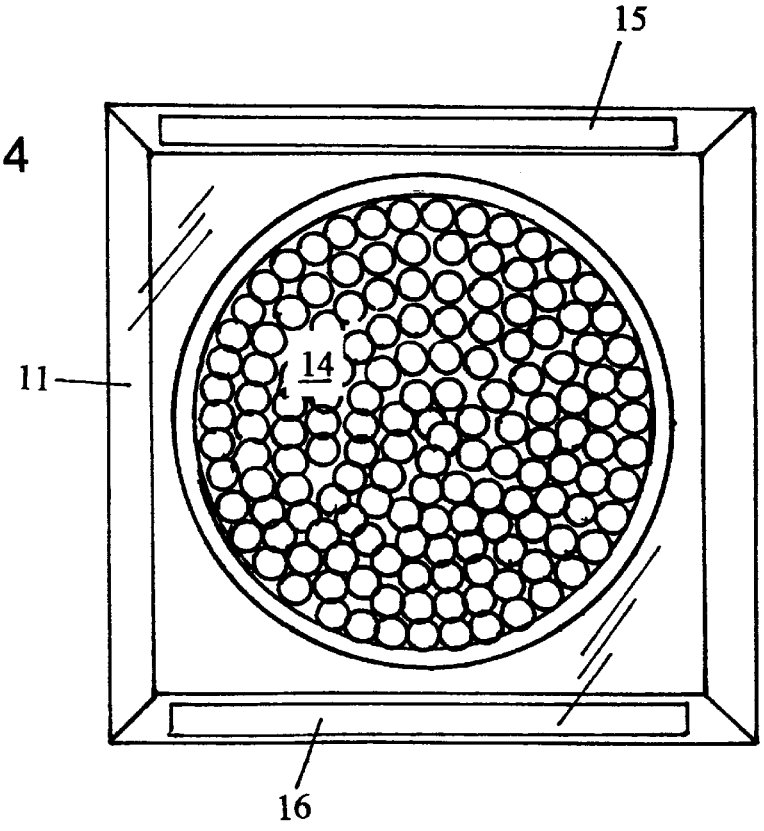

PROFESSIONAL DESK TROPHY

BACKGROUND—FIELD OF INVENTION

This invention relates to desk paperweights, display devices, and trophy constructions, specially one designed to recognize academic achievement in a professional post-graduate school program rather than from a physical activity achievement.

BACKGROUND—DESCRIPTION OF PRIOR ART

Prior academic achievement awards have been limited to fairly standard paper diplomas and certificates. No prior art is similar to the invention nor recognizes academic achievement in such a unique, bold, and three-dimensional fashion. Paper diplomas do signify the achievement of a certain level of education but fail to provide a constant reminder to the new profession graduate of how unique his or her achievement really is, when compared with the general population. Paper diplomas usually are placed on a wall behind the recipient's desk where he or she cannot usually view it while at work. Some diplomas can be very unremarkable even if they are placed in a highly visible location.

OBJECTS AND ADVANTAGES

Accordingly, the invention has the following objects and advantages in that it a) is designed to be placed on the recipient's desk, becoming a much more visible, interesting, and striking reminder of the academic achievement, b) is a reminder of the level of uniqueness the professional degree has now conferred on the individual by physically displaying three-dimensionally the ratio of people in the general population to members of the recipient's new current profession;

c) provides a demographic display of how many new clients, customers, consumers, or patients are potentially available to the new professional;

d) displays a motto that maintains and enhances the recipient's level of personal self-esteem;

e) is custom made to display the recipient's name, professional degree, school name, and year of graduation, much like a physical activity trophy or award, something many people have never received;

f) promotes conversation and discussion; it is a wonderful gift item, to be given to the graduate by the professional school or by the recipient's family or friends; it is also an appropriate gift item for an experienced professional;

g) can be customized to "fit" just about any profession-dentistry, medicine, pharmacy, chiropractic, podiatry, architecture, etc.;

These objects and advantages of my invention will become more apparent from a consideration of the drawings and ensuing description.

DESCRIPTION OF DRAWINGS

FIG. 3 is an overhead view of the desk trophy.

FIG. 4 is an underneath view of the desk trophy.

REFERENCE NUMERALS IN DRAWINGS

10 Dome
11 Base
12 Gold Ball
13 Silver Ball
14 Allotment of Silver Balls
15 Gold Plaque
16 Gold Ball

DETAILED DESCRIPTION

Figure 1:
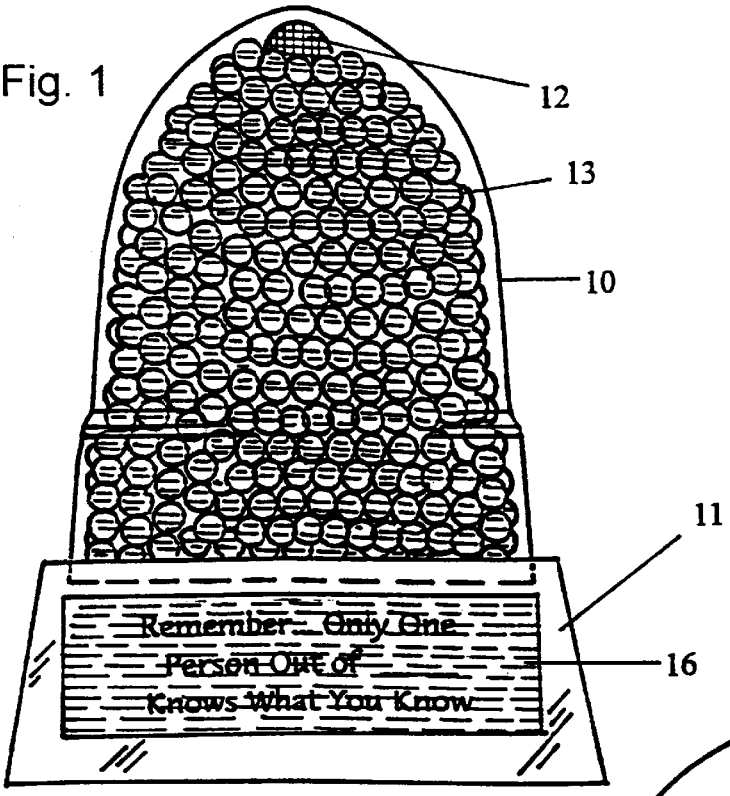
FIG. 1 is a rear elevation view of the complete desk trophy including standard drafting symbol patterns for representing color.
Figure 2:
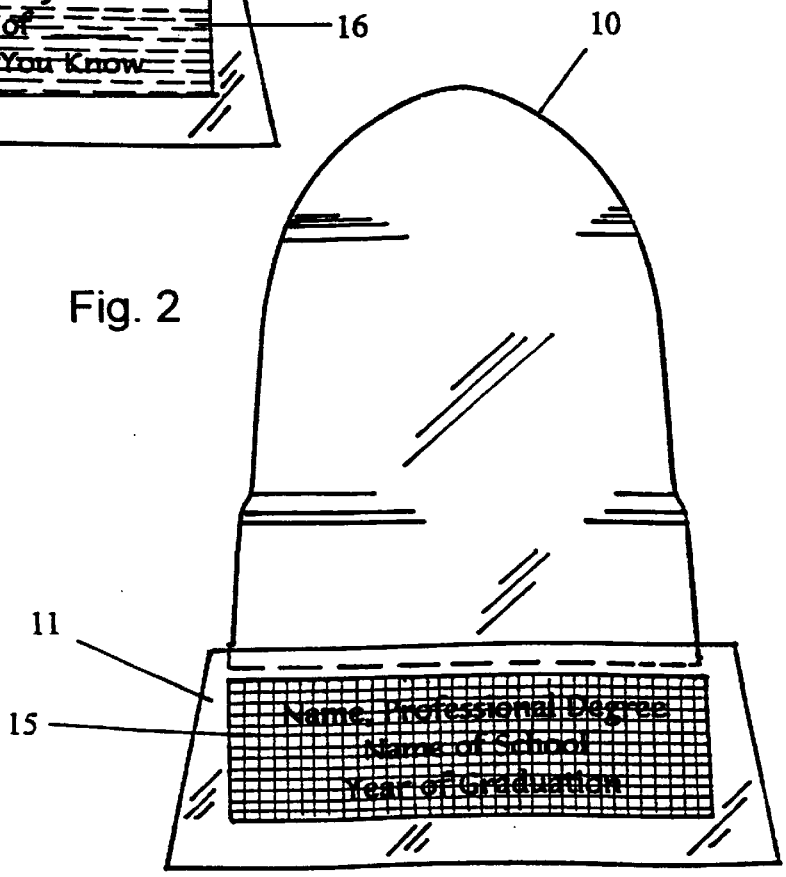
FIG. 2 is a front elevation view of the contralateral side shown in FIG. 1. The metal balls contained in the dome have been omitted to better display the complete shape of the dome housing. The affixed plaque is shown in a standard drafting symbol pattern for representing presenting color.
Figure 5:
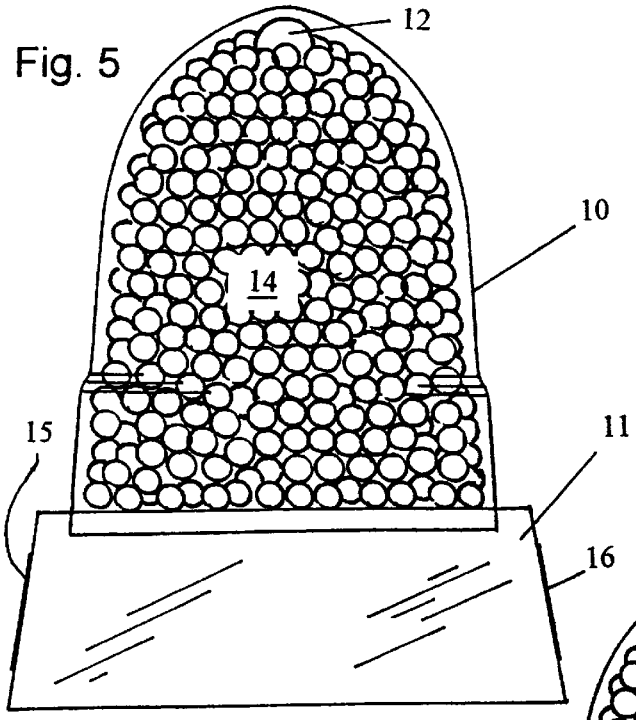
FIG. 5 is another elevation view of one of the lateral sides not shown in either FIG. 1 or 2. The contralateral side to this view is identical.
Figure 6:
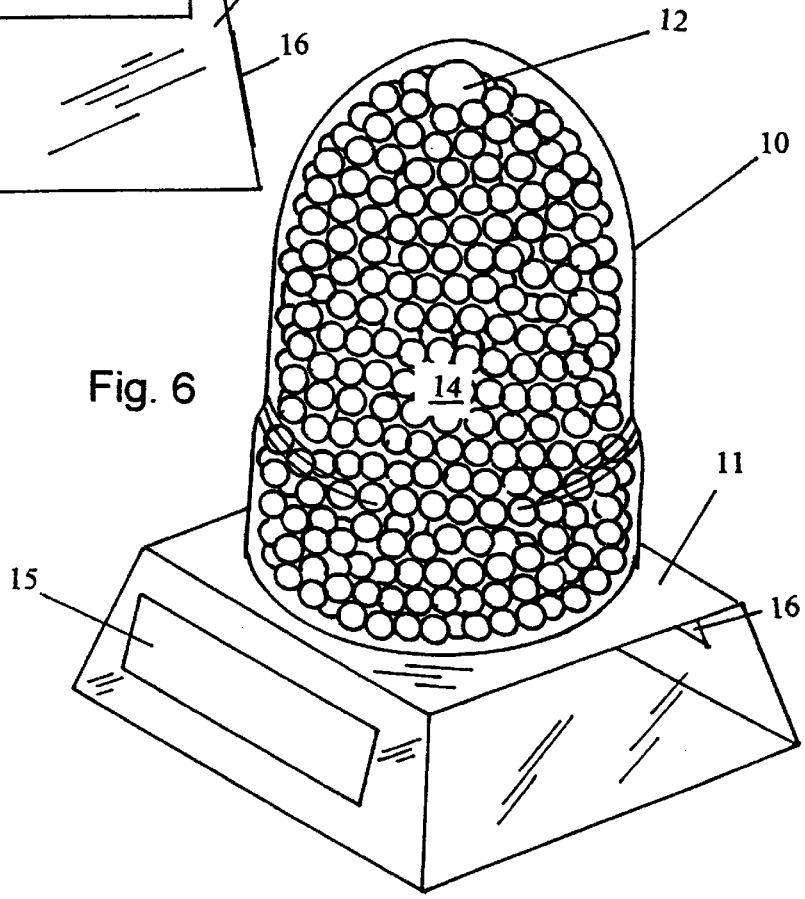
FIG. 6 is a perspective view of the complete desk trophy with the visible plaque not inscribed.

A typical embodiment of my desk trophy is illustrated in FIGS. 1 and 2. My trophy design is comprised of five components. A three dimensional dome(10) is affixed to a three dimensional base(11) upon which is affixed two metal plaques(15, 16). An allotment of metal balls(14)is housed within the dome along with a larger metal ball(12) that is supported in the most superior position within the dome by the subjacent smaller metal balls.

A dome(10) is constructed of clear plastic acrylic material via a vacuum forming process. The majority of the dome component is of a parabolic shape which eventually blends into a parallel cylindrical shape via a small shoulder—FIG. 2. In the embodiment shown in FIGS. 1 through 6, the dome is 8 cm high with a diameter of 6.5 cm; the plastic is approximately 1.5 mm thick.

A base(11) is a three dimensional trapazoidal piece of polished clear lucite plastic. Upon the smaller of the two horizontal surfaces is machined a round square-bottomed groove approximately 5 mm deep of a diameter identical to that of the open end of the dome. In this embodiment shown in the figures, the base has a lower square dimension of 9 cm, with a height of 3.5 cm, and with an upper square dimension of 7.5 cm.

Upon one vertically angled side of the base(11) is affixed a silver colored metal plaque of smaller dimensions(16), 7 cm by 1.9 cm, on which is inscribed the words: "Remember . . . Only One Person Out of _____ Knows Upon the contralateral vertically angled side of the base is affixed another metal plaque, this one gold colored, with identical dimensions. On this plaque(15) is inscribed the name of the trophy recipient, the initials of the professional degree conferred, the name of the conferring school, and the year of graduation.

Within the dome is an allotment of silver colored stainless steel semi-precision metal balls(14) present in a size and number peculiar to the profession being highlighted by the trophy. These metal balls are commerically available through many manufacturers and are produced in a wide range of diameters. The diameter of each of the silver balls in this embodiment is approximately 5 mm.

A gold colored semi-precision metal ball having a diameter of at least twice that of the individual silver colored metal balls is placed in the most superior portion of the dome, and it's position there is maintained by the subjacent allotment of silver metal balls. In this embodiment, the gold ball is approximately 11 mm in diameter.

The trophy is assembled by first placing the single gold colored metal ball into an inverted dome. The allotment of silver metal balls is slowly added to the dome so as to avoid displacing the gold ball from it's now most inferior position. When the dome is filled with silver metal balls to with 5 mm of the rim, the machined groove on the base surface is painted with a plastic welding liquid; the base is inverted, and placed over the open dome, firmly placing the rim into the groove.

The plaques are affixed to the base sides with double-sided adhesive tape.

OPERATION

My desk trophy design is applicable to graduates of many different professions.

The one embodiment shown in FIGS. 1 through 6 has been constructed for dentistry. There are approximately 150,000 dentists in our country, with a general population of approximately 260,000,000; or aproximately one dentist for every 1700 citizens. Therefore, the dome(10) has been appropriately sized, and it is filled with approximately 1700 silver metal balls(14) with a diameter of 5 mm. The top gold colored metal ball(12), signifying the dentist in this case, has a diameter of 11 mm. The silver plaque(16) would be inscribed with the words: "Remember . . . Only One Person in 1700 Knows What You Know." The gold plaque(15) would be inscribed with the following words and numbers: Robert C. Fisher D.M.D., University of Pennsylvania, 1980, according to the layout shown in FIG. 2.

My desk trophy can be altered and reconfigured to "fit" other professions. For instance, there is approximately 1 chiropractor for every 5,400 individuals in this country. To construct a "chiropractic" version of my desk trophy, the size of the silver metal balls would be decreased to allow for the housing of 5,400 of them within the dome, with, or without slightly increasing the height of the cylindrical portion of the dome. The same adjustments would be made to construct a trophy for a podiatrist(ratio of one per 21,000 people) or optometrist ratio of one per 8,666 people). Other suitable recipients of the invention are pharmacists, physicians, certified public accountants, lawyers, architects, patent examiners, etc. The professional applications are very wide and numerous.

My desk trophy can also be introduced into the mass consumer market. For example, a "Mother's Day" or "Father's Day" gift trophy could be constructed. "Happy Mother's Day . . . You're One in a Million" could be inscribed on the silver plaque. The gold plaque would have the recipient's name, date of presentation, gift giver's name, etc. The dome would house approximately one million minature silver balls of a very small diameter, topped off by a much larger gold colored one. There are numerous possibilities for other applications, including business awards.

CONCLUSION, RAMIFICATION, AND SCOPE OF INVENTION

Accordingly, the reader will see that this professional desk trophy emphasizes a personal achievement in a very physically graphic manner. It is a very dignified, visually appealing, substantial display that can carry just as much "weight" (not just physically)as a diploma or certificate. The invention can be constructed to specifications peculiar to many different professions and occupations, as well as to family and friends.

It is a graphic reminder of how unique certain professionals are in our society; it is a graphic reminder of how many potential clients, customers, or patients there are in this country for the trophy recipient; it is a beautiful conversation piece; it is desk paperweight; and it enhances one's self-esteem.

What I claim:

1. A trophy and decorative paperweight display with a three-dimensional trapezoidal plastic base with parallel top and bottom surfaces and angled sides with a full circular shallow recess machined into the top surface, whereby the top surface is smaller than the bottom surface;

a clear hollow plastic molded dome housing with a parabolic dome top portion that flows into a cylindrical shaped bottom portion, the bottom portion has a diameter corresponding in size to said recess machined on said base, said housing rest within the recess;

a plurality of stainless steel silver colored metal balls that fill said dome housing; and whereby said balls are a number which are adapted to approximately corresponds to the number of USA citizens that is demographically allotted to each perculiar member of a specific profession that is recognized by the trophy;

a single gold colored metal ball of a size at least 100% larger than any one of said silver metal balls; said gold ball is positioned atop the silver balls within said dome housing when the dome is filled with said silver metal balls;

a silver colored metal plaque that is affixed to one of the angled sides of said trapezoidal base, and on which is inscribed the words; "Remember . . . Only One Person in x Knows What You Know" with the x equal to the number of said silver balls housed in said dome housing;

a gold colored metal plaque of identical size to said silver plaque affixed angled side opposite to the one angled side supporting said silver colored plaque, having inscription thereon.

* * * * *